United States Patent [19]

Watanabe et al.

[11] 4,180,721

[45] Dec. 25, 1979

[54] METHOD OF CONTROLLING FIXING TEMPERATURE OF POWDER IMAGE IN ELECTROPHOTOGRAPHIC COPYING MACHINE

[75] Inventors: Tsutomu Watanabe, Tokyo; Nobuyuki Yanagawa, Chigasaki; Masao Hosaka, Sagamihara, all of Japan

[73] Assignee: Ricoh Company, Ltd., Japan

[21] Appl. No.: 832,744

[22] Filed: Sep. 12, 1977

[30] Foreign Application Priority Data

Sep. 22, 1976 [JP] Japan ..... 51-114076

[51] Int. Cl.[2] ..... H05B 1/00

[52] U.S. Cl. ..... 219/216; 219/358

[58] Field of Search ..... 219/216, 388; 355/3 FU

[56] References Cited

U.S. PATENT DOCUMENTS

| | | | |
|---|---|---|---|
| 3,532,855 | 10/1970 | Van Cleave | 219/216 |
| 3,783,235 | 1/1974 | Sprague | 219/216 |
| 3,881,085 | 4/1975 | Traister | 219/216 |

*Primary Examiner*—C. L. Albritton

*Attorney, Agent, or Firm*—McGlew and Tuttle

[57] ABSTRACT

A method of controlling the fixing temperature of a powder image comprises the steps of detecting electric power, which is supplied from a power source to a heating element that is contained in a powder image fixing unit to heat the image, by means of a power detector, and controlling the power supplied to the heating element in accordance with an output signal from the detector, thus preventing a variation in the fixing temperature which might result from a fluctuation in the source voltage.

6 Claims, 6 Drawing Figures

METHOD OF CONTROLLING FIXING TEMPERATURE OF POWDER IMAGE IN ELECTROPHOTOGRAPHIC COPYING MACHINE

BACKGROUND OF THE INVENTION

The invention relates to a method of controlling the fixing temperature of a powder image in an electrophotographic copying machine.

It is well known in the art of electrophotography that a powder or toner image obtained on a copy sheet can be fixed as a permanent image by causing the toner to be melted under heat to be fused with the copy sheet. A heating element may be used to this end and directly fed from a power source. A fixing unit of this kind is subject to a large variation in the amount of power supplied thereto in response to a fluctuation in the source voltage. Since the power supplied to the heating element is proportional to the square of the source voltage, it can be seen that the power may vary as much as 50% between source voltages of 90 and 100 volts, for example, as shown below.

$$110^2/90^2 = 12100/8100 \simeq 1.5$$

This results in a large change in the fixing temperature, and causes a substantial degradation in the fixing characteristic of the powder image to the sheet.

SUMMARY OF THE INVENTION

A change in the fixing temperature which results from a variation in the power supplied to the heating element used for heating the toner image can be prevented by detecting the amount of power supplied from a power source to the heating element by means of a power detector, and properly controlling the power supplied in accordance with an output signal from the power detector.

Therefore, it is an object of the invention to provide a method of controlling the fixing temperature of a powder image which avoids the disadvantage found in prior art arrangements.

The invention may be applied to an environmental fixing process in which heat radiation from a heating element is applied to the powder image or to a heat conduction process in which the powder image is brought into contact with the surface of a roller which is heated by a heating element. Alternatively, the invention may be applied to any other heat fixing process.

DETAILED DESCRIPTION OF PREFERRED EMBODIMENTS

Figure 1:
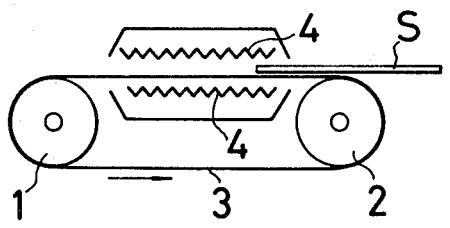
FIG. 1 is a schematic side elevation of an environmental fixing unit to which the invention may be applied.

Referring to FIG. 1, there is shown an environmental fixing unit having a relatively low heat capacity and hence a rapid heating response upon energization of the heating element. The fixing unit includes a pair of spaced rollers 1, 2 around which a belt 3 extends for conveying a copy sheet S thereon. The unfixed toner image formed on the copy sheet is fixed under heat by its passage through a heating element 4 which is disposed above and below the upper run of the belt 3.

Figure 2:
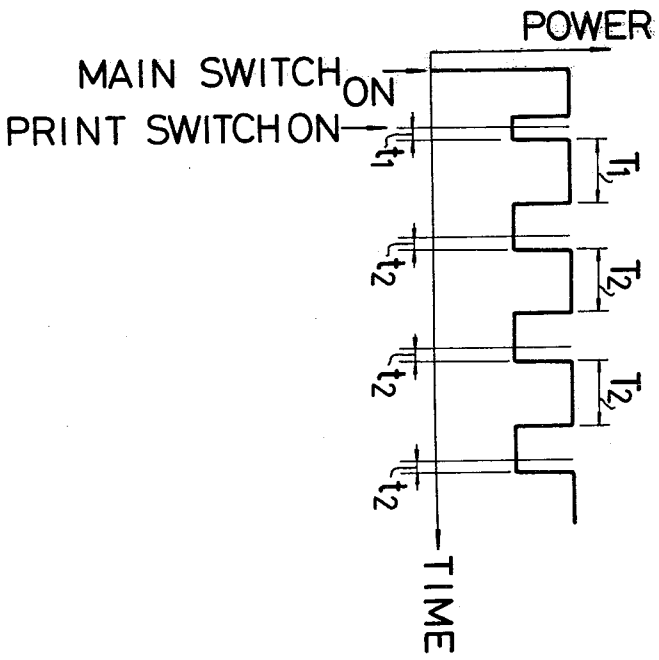
FIGS. 2 and 3 graphically illustrate the operation of the invention.
Figure 4:
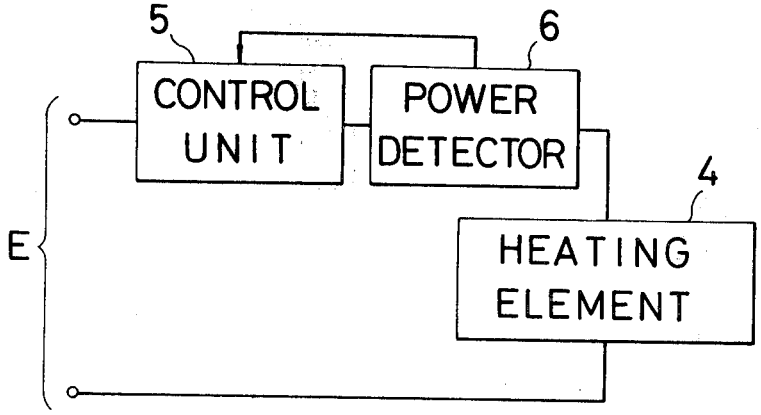
FIGS. 4 and 5 are block diagrams of embodiments of the invention.

As shown in FIG. 4, the heating element 4 is fed from an a.c. source E through a control unit 5, and the amount of power supplied is detected by a power detector 6. Referring to FIG. 2, when a main switch of a copying machine is turned on, power is supplied to the heating element 4 at a higher power level until the temperature of the element rises to a given value, whereupon the power supplied to the element 4 is reduced to a low level so as to maintain its temperature constant. Subsequently when a print switch of the machine is turned on, the power supply to the element 4 is increased to a high level after a time delay $t_1$ and is maintained at such level for a given time interval $T_1$ in order to avoid a temperature decrease which occurs as a result of heat dissipation by the copy sheet. Where plural copies are to be produced in succession, the power supply is switched to the high level after a time delay $t_2$ from the beginning of each copy cycle and the high level is maintained for a given time interval $T_2$.

Figure 5:
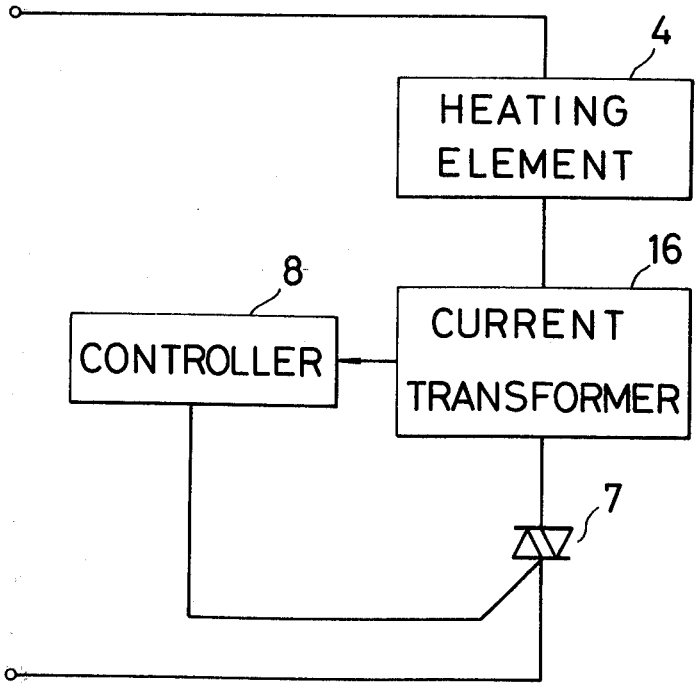

In addition, the power supply to the heating element 4 is controlled by the control unit 5 which responds to an output signal from the power detector 6 in order to prevent a change in the fixing temperature which might be caused by a fluctuation in the source voltage. Referring to FIG. 5, the power detector 6 comprises a current transformer 16 which senses the current flow to the element 4. The control unit 5 comprises a triac 7 and a controller 8. The element 4 is supplied with 100 volt a.c. voltage from a commercial a.c. supply line through the triac 7.

Figure 6:
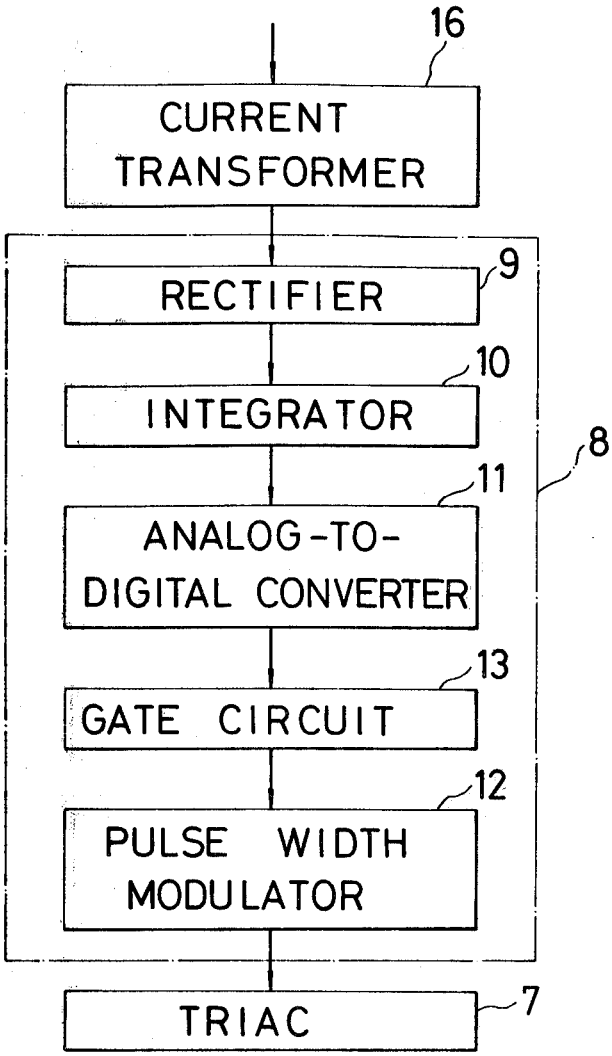
FIG. 6 is a block diagram of the controller shown in FIG. 5.

The controller 8 is shown in more detail in FIG. 6. Specifically, an a.c. output from the transformer 16 is rectified into a d.c. voltage by a rectifier 9. The pulsating output waveform of the rectifier 9 is smoothed by an integrator 10, which feeds an analog-to-digital converter 11, thus producing a digital signal. The converter 11 may comprise an arithmetic amplifier or a plurality of low cost comparators and is capable of providing a few bits to assure a smooth power control. The output signal of the converter 11 is fed to a gate circuit 13, which in turn performs a pulse width control of a pulse width modulator 12. The triac 7 is triggered by a variable width output pulse of the modulator 12. In this manner, the duration of the power supply to the heating element 5 is controlled in accordance with the magnitude of the current which flows through the current transformer 16, thus avoiding a change in the fixing temperature as the source voltage fluctuates.

Figure 3:
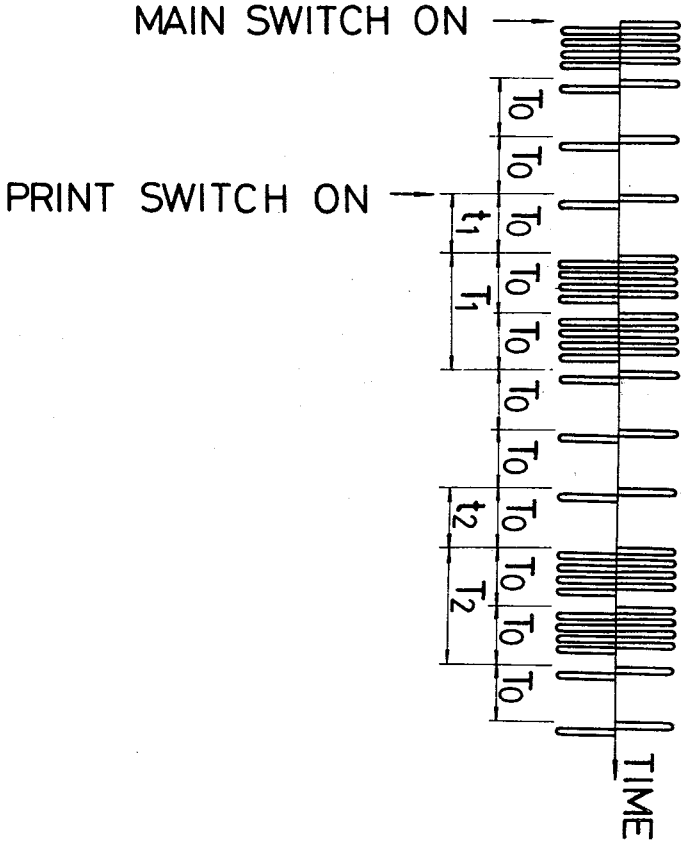

It is to be understood that the pulse width modulator 12 is also subject to a pulse width modulation in response to a controlling condition in the copying machine in order to achieve the power control mentioned above in connection with FIG. 2. As an alternative to the pulse width control described above, FIG. 3 shows the power being controlled, by the control unit 5 responsive to output signals from power detector 6, in terms of the number of a.c. cycles.

While specific embodiments of the invention have been shown and described in detail to illustrate the application of the principles of the invention, it will be understood that the invention may be embodied otherwise without departing from such principles.

What is claimed is:

1. A method of controlling the fixing temperature of a heating element contained in a fixing unit to maintain the fixing temperature constant despite fluctuations in the voltage of a power source supplying the heating element, the method comprising the steps of detecting the current supplied to the heating element using a current transformer to detect the power supplied from the power source to the heating element to provide an output control signal corresponding to the power supplied to the heating element; and utilizing such output control signal to modulate the power supplied to the heating element to maintain constant the supply power to maintain the fixing temperature constant despite fluctuations of the voltage of the power source.

2. A method of controlling the fixing temperature of a heating element contained in a fixing unit to maintain the firing temperature constant despite fluctuations in the voltage of a power source supplying the heating element, the method comprising the steps of:

detecting the power supplied from the power source to the heating element by detecting the current supplied to the heating element using a current transformer to produce an a.c. output signal corresponding to the power supplied to the heating element;

rectifying said a.c. output signal to produce a d.c. voltage signal having a wave form characteristic of the a.c. output signal;

smoothing said d.c. voltage signal with an integrator to form a smooth d.c. voltage signal;

feeding the smoothed d.c. voltage signal to an analog/digital converter for producing a digital signal corresponding to the smoothed d.c. voltage signal;

applying the digital signal to a gate circuit for producing a pulse width control signal corresponding to the digital signal;

supplying the power from the power source to the heating element in successive pulses; and modulating the pulse width of the successive pulses with the pulse width control signal.

3. A method of controlling the fixing temperature of a heating element, as claimed in claim 1, including the step of supplying the power from the power source to the heating element in successive time periods; and utilizing such output control signal to control the length of such time periods.

4. A method of controlling the fixing temperature of a heating element, as claimed in claim 3, in which the power is supplied to the heating element in successive pulses; and utilizing such output control signal to modulate the width of the pulses.

5. A method of controlling the fixing temperature of a heating element, as claimed in claim 3, in which each time period is constituted by at least one cycle of alternating current; and utilizing such output control signal to control the number of cycles of alternating current in each time period.

6. A method of controlling the fixing temperature of a heating element, as claimed in claim 1, the step of rectifying the output of the current transformer; converting the rectified output into d.c. pulses; modulating the width of the pulses; and utilizing the modulated width pulses to supply current to the heating element.

* * * * *